US011685039B1

(12) United States Patent
Heath, Jr.

(10) Patent No.: US 11,685,039 B1
(45) Date of Patent: Jun. 27, 2023

(54) ROUTER BIT RACK, SYSTEM AND METHOD THEREOF

(71) Applicant: Woodpeckers, LLC, Strongsville, OH (US)

(72) Inventor: Mark Robert Heath, Jr., Strongsville, OH (US)

(73) Assignee: WOODPECKERS, LLC, Strongsville, OH (US)

( * ) Notice: Subject to any disclaimer, the term of this patent is extended or adjusted under 35 U.S.C. 154(b) by 0 days.

(21) Appl. No.: 17/583,742

(22) Filed: Jan. 25, 2022

(51) Int. Cl.

| | |
|---|---|
| ***B25H 3/00*** | (2006.01) |
| ***B25H 3/04*** | (2006.01) |
| ***A47F 5/08*** | (2006.01) |
| ***A47F 7/00*** | (2006.01) |

(52) U.S. Cl.
CPC ..... *B25H 3/003* (2013.01); *B25H 3/04* (2013.01); *A47F 5/0807* (2013.01); *A47F 7/0028* (2013.01)

(58) Field of Classification Search
CPC .. B25H 3/003; B25H 3/04; B25H 3/06; A47F 5/0807; A47F 7/0028; A47F 5/08; A47F 5/0838; A47F 5/0846; A47F 5/0853; A47B 96/061; A47B 96/067
USPC ..... 211/87.01, 70.6, 94.01, 69, 88.01, 90.01
See application file for complete search history.

(56) References Cited

U.S. PATENT DOCUMENTS 1,559,842 A * 11/1925 Bollinger ..... E06C 1/381 248/217.1
1,596,951 A 8/1926 Smith
2,065,340 A 12/1936 McNaught et al.
2,065,341 A 12/1936 McNaught et al.
2,572,624 A * 10/1951 Jeter, Sr. ..... A47G 21/14 211/70.1
2,587,226 A * 2/1952 Rodman ..... B25H 3/04 211/65
3,139,255 A * 6/1964 Palm ..... G09F 5/00 248/152
3,179,255 A * 4/1965 De Caccia ..... B25H 3/04 248/314

(Continued)

OTHER PUBLICATIONS

Tool Guyd, "Woodpeckers RackBit Router Bit Storage System", (published Oct. 21, 2021), Toolguyd.com, URL:<https://toolguyd.com/woopeckers-rackbit-router-bit-storage-system/> (Year: 2021).

(Continued)

*Primary Examiner* — Jennifer E. Novosad
(74) *Attorney, Agent, or Firm* — Sand, Sebolt & Wernow Co., LPA

(57) ABSTRACT

A rack for supporting items defines a channel or trough to receive support bases or blocks therein. Each support base carries at least one item. One item may be a router bit. The rack and support base(s) may collectively define a router bit storage and display system that can be mounted to a support surface, such as a wall or a router table. The system enables a woodworker to safely store and easily access router bits for use in their router device when needed. The router bits are maintained spaced apart from each other when supported by the rack so as to not damage each other. The system can be modular or modularly expanded to grow with the woodworker such that when the woodworker acquires more router bits, the system can add more racks and support bases to ensure there is adequate room for the woodworker's additional router bits.

13 Claims, 5 Drawing Sheets

(56) References Cited

U.S. PATENT DOCUMENTS 3,285,427 A * 11/1966 Dando ..... B25H 3/00 211/70.6
3,298,531 A * 1/1967 Wilcke ..... A47L 13/512 211/70.6
D231,765 S 6/1974 Kean
4,064,991 A * 12/1977 Swanson ..... A47F 5/0823 211/49.1
4,069,627 A * 1/1978 Pegg ..... E04B 1/24 52/656.5
4,112,412 A 9/1978 Howlett
4,184,433 A * 1/1980 Green ..... B61D 37/00 105/325
4,194,636 A * 3/1980 Byram ..... G11B 23/023 211/41.12
4,209,098 A 6/1980 Adams
4,310,094 A * 1/1982 Hotchkiss, Jr. ..... A47F 5/0884 D8/367
4,353,465 A * 10/1982 Rado ..... B65D 25/106 312/902
4,365,720 A * 12/1982 Kaneshiro ..... B25H 3/006 211/73
4,403,700 A * 9/1983 Manlove ..... B43M 99/008 211/88.01
D271,903 S 12/1983 Kaufman
4,446,972 A * 5/1984 Sussman ..... A47G 29/08 211/60.1
4,535,897 A * 8/1985 Remington ..... B25H 3/00 211/74
4,594,660 A 6/1986 Guenthner et al.
4,607,752 A * 8/1986 Sherrow ..... B44D 3/123 248/110
D292,553 S 11/1987 Logstrup et al.
4,714,158 A * 12/1987 Oltman ..... A45C 13/02 206/349
4,730,799 A * 3/1988 Foss ..... B25H 3/006 248/51
4,736,918 A 4/1988 Bessinger
4,765,675 A 8/1988 Bergl et al.
D301,304 S 5/1989 Will
4,934,642 A 6/1990 Baron et al.
D316,214 S 4/1991 O'Donnell
5,038,944 A 8/1991 Sorensen et al.
5,129,528 A * 7/1992 Eidsmoe ..... B25H 3/003 211/70.6
5,141,194 A * 8/1992 Burgess ..... B60N 3/102 297/188.17
5,184,425 A 2/1993 Anderson
5,284,245 A * 2/1994 Slivon ..... B25H 3/003 206/378
5,328,037 A * 7/1994 Fujii ..... A47F 5/0846 211/88.01
5,356,103 A * 10/1994 McClurg ..... A47B 96/067 211/90.03
5,452,810 A 9/1995 Schwartz
5,615,782 A * 4/1997 Choe ..... A45D 44/02 211/60.1
5,641,079 A * 6/1997 Schmidt ..... A47F 5/0823 211/104
D390,241 S 2/1998 Mori
D410,372 S 6/1999 Strauch
5,975,295 A * 11/1999 Diamond ..... A61M 5/008 206/366
6,041,947 A * 3/2000 Heneveld ..... A47B 81/005 211/70.1
D424,579 S 5/2000 Brady
D429,262 S 8/2000 Streich
6,109,446 A * 8/2000 Foote ..... A45D 1/04 219/242
D430,578 S 9/2000 Brady
D430,983 S 9/2000 Hirota
6,227,388 B1 * 5/2001 Borzelleca ..... F21V 21/34 362/393
D449,518 S 10/2001 Snider et al.
D459,372 S 6/2002 Asano
6,425,489 B1 * 7/2002 Cunningham ..... B25H 3/003 211/70.6
6,571,966 B1 * 6/2003 Hsiao ..... A47F 7/0028 206/379
6,575,311 B1 * 6/2003 Fink ..... A47F 7/0028 211/70.2
6,749,074 B1 6/2004 Hileman et al.
D494,436 S 8/2004 Winig et al.
D506,730 S 6/2005 Ura
6,981,677 B1 * 1/2006 Tjeerdsma ..... B25H 3/04 248/316.1
D517,489 S 3/2006 Kawase et al.
7,036,668 B2 * 5/2006 Udy ..... B25H 3/04 211/60.1
7,188,726 B2 * 3/2007 Lin ..... B25H 3/003 206/743
D544,460 S 6/2007 Yau
D547,788 S 7/2007 Cheng
D550,668 S 9/2007 Park et al.
D555,616 S 11/2007 Lin
D591,318 S 4/2009 Shimada
7,523,832 B2 4/2009 Kao
D599,193 S 9/2009 Meyer et al.
7,591,385 B2 * 9/2009 Brooks ..... B25H 3/04 211/94.01
7,610,724 B2 * 11/2009 Houk, Jr. ..... E04B 7/022 52/634
7,717,044 B2 * 5/2010 Hatton ..... A47F 9/00 108/92
D619,070 S 7/2010 Pollmann
7,798,336 B2 * 9/2010 Shiao ..... B25H 3/04 211/DIG. 1
D625,694 S 10/2010 Morikawa et al.
D637,851 S 5/2011 Hsieh
8,070,118 B1 * 12/2011 Collins ..... A47F 5/0861 248/225.11
8,733,561 B2 * 5/2014 Kao ..... B25H 3/04 211/94.01
8,869,996 B1 * 10/2014 Christenson ..... A45D 44/06 211/26.2
D726,153 S 4/2015 Chang
D752,495 S 3/2016 Garbas
9,699,924 B2 * 7/2017 Hagen ..... H05K 5/0204
D810,553 S 2/2018 Amato
D811,855 S 3/2018 Stultz
D825,926 S 8/2018 Lauber
10,293,756 B1 * 5/2019 Kollias ..... B64D 11/00
10,352,065 B2 * 7/2019 Grumberg ..... E04H 15/648
D862,202 S 10/2019 Niu
D887,253 S 6/2020 Jaramillo
D910,872 S 2/2021 White et al.
D929,210 S 8/2021 Pan et al.
D937,651 S 12/2021 Li et al.
D944,076 S 2/2022 Quatraro et al.
D948,998 S 4/2022 Noe
D956,523 S 7/2022 Templeman
D956,524 S 7/2022 Templeman
D959,239 S 8/2022 Johnson
D959,248 S 8/2022 Strohman
D959,960 S 8/2022 Witherbee et al.
D959,965 S 8/2022 Strohman
D959,966 S 8/2022 Strohman
D959,967 S 8/2022 Strohman
D959,968 S 8/2022 Strohman
D965,394 S 10/2022 Yin
2005/0194332 A1 * 9/2005 Berfield ..... A47L 13/51 211/70.6
2006/0102569 A1 * 5/2006 Laga ..... A47F 5/0807 211/70.6
2007/0210021 A1 * 9/2007 Whitehead ..... B25H 3/04 211/70.6
2007/0256996 A1 11/2007 Jackle
2008/0179265 A1 * 7/2008 Lin ..... B25H 3/04 211/70.6
2008/0251476 A1 * 10/2008 Shiao ..... B25H 3/04 211/70.6
2009/0050501 A1 2/2009 Serpico et al.

(56) References Cited

U.S. PATENT DOCUMENTS

| | | | | |
|---|---|---|---|---|
| 2009/0090644 | A1 | 4/2009 | Kao | |
| 2010/0200527 | A1* | 8/2010 | Hernandez | A47F 7/0028 211/70.6 |
| 2011/0084039 | A1* | 4/2011 | Walters | A47F 7/0028 248/65 |
| 2012/0168579 | A1 | 7/2012 | Heersink | |
| 2015/0352709 | A1 | 12/2015 | Diamond | |
| 2018/0104812 | A1 | 4/2018 | Wacker | |
| 2019/0291264 | A1 | 9/2019 | Mefferd | |
| 2021/0220977 | A1 | 7/2021 | Kukucka et al. | |

OTHER PUBLICATIONS

Powertec, 71345 Router Bit Tray for Darwer Storage, (first available Aug. 13, 2018), Amazon.com, URL:<https://www.amazon.com/POWERTEC-71345-Router-1/2-inch-Shank/dp/B07GDLJ1CZ> (Year: 2018).

Rockler Hardware, Rockler Router Bit Storage Inserts, (site vistited Oct. 14, 2022) Rockler website, URL:,https://www.rockler.com/rockler-router-bit-storage-inserts-10-pack> (Year: 2022).

Huot 14805 Collet Rack, Date Visited: Oct. 20, 2022, Amazon, Date Available: Jun. 22, 2008, URL:<https://www.amazon.com/Huot-14805-Collet-Rack-Collets/dp/B001F76R4> (Year: 2008).

18 in Rocker Router Bit Storage Rack, Date Visited: Oct. 20, 2022, Amazon, Date Available: Nov. 9, 2004, URL:<https://www.amazon.com/Rockler-Router-Bit-Storage-Rack/dp/B003FTS532> (Year:2004).

* cited by examiner

ROUTER BIT RACK, SYSTEM AND METHOD THEREOF

TECHNICAL FIELD

This present disclosure relates to a rack for supporting items thereon. The rack may be shaped to hold items an angle to provide easy access to the items so that the items may be easily removed from the rack for use, and thereafter be easy replaced or reinstalled on the rack subsequent to their use. Specifically, the rack is configured to support and store one or more router bits for a woodworking tool, such as a router. The router bits may be carried by a support base that is slidably retained on the rack.

BACKGROUND

Router bits are specialty tools used in woodworking that come in a large variety of designs to create either decorative effects or joinery aids. Generally, they are classified as either high-speed steel (HSS) or carbide-tipped, however some recent innovations such as solid carbide bits provide even more variety for specialized tasks.

Aside from the materials they are made of, bits can be classified as edge bits or non-edge bits, and whether the bit is designed to be anti-kickback. Edge bits have a small wheel bearing to act as a fence against the work in making edge moldings. These bearings can be changed by using commercially available bearing kits. Changing the bearing, in effect, changes the diameter of the cutting edge. This is especially important with rabbeting/rebating bits. Non-edge bits require the use of a fence, either on a router table or attached to the work or router. Anti-kickback bits employ added non-cutting bit material around the circumference of the bit's shoulders which serves to limit feed-rate. This reduces the chance that the workpiece is pushed too deeply into the bit (which would result in significant kickback from the cutting edge being unable to compensate).

Sometimes complementary bits come in sets designed to facilitate the joinery used in frame and panel construction. One bit is designed to cut the grove in the rail and stile pieces while the other shapes the edge of the panel to fit in the grove.

Due to the aforementioned specific shapes and desired cut profile, a woodworker may have many different types of router bits to accomplish various tasks. Router bits are expensive and must be maintained in good working condition to ensure that they perform as desired. If router bits are loosely stored together, there is a tendency for them to contact and bump into each other that may risk damage to the cutting surface of the router bit. This is detrimental due to the cost of the router bits and the precision they require.

To address this risk, previous attempts have provide router bit storage systems. Some previous solutions provided storage trays for route bits. The storage trays may be formed for foam board (i.e., a planar piece of foam) with a plurality of spaced apart holes or apertures therein that are each sized to respectively receive the shank of one router bit therein.

However, these planar foam boards used for router bit storage are not without fault. The planar boards used for router bit storage are often stored in the drawer thus reducing the ease of access to the router bits. Further, the foam may loosen which still can allow the router bits to bump into each other and become damaged.

SUMMARY

The present disclosure addresses these and other issues by providing a rack for storing items thereon. The rack may be specifically configured to store or support a plurality of router bits thereon. The rack is designed to be attached to a wall so that the router bits can be easily accessed, unlike those prior art systems that utilized a foam board to store the router bits. The rack may be angled outwardly from a support surface or wall and downwardly in a manner that provides easy access for the operator to remove a router bit and reattach the router bit to the rack after having performed a woodworking task.

In one exemplary embodiment, the present disclosure provides a rack system composed of a rack and support bases or blocks (also commercially knowns as bit blocks). The rack of this exemplary disclosure, which may commercially be known as the RackBit Router Bit Storage System and available for sale by Woodpeckers, Inc. takes a modular approach to router bit storage. This exemplary embodiment of a system enables and provides a storage solution that enables the owner's (i.e., woodworker) storage system to grow and expand as the owner's number of router bits increases. The system starts with the molded router bit support bases, which hold both ¼" and ½" shank router bits. One exemplary rack may be a powder-coated steel rack that mounts to a wall, a cabinet, or to the side of a router table (i.e., that is to say any support surface). The rack holds the bit bases or support bases neatly and securely with the router bits in plain sight an within easy reach.

In another aspect, an exemplary embodiment may provide a rack for supporting items, wherein the rack defines a channel or trough to receive support bases or blocks therein. Each support base may carry at least one item. One item carried by the support bases may be a router bit. The rack and support base(s) may collectively define a router bit storage and display system that can be mounted to a support surface, such as a wall, a cabinet, or to the side of a router table. The system enables a woodworker to safely store and easily access router bits for use in the woodworker's router device when needed. The router bits are maintained spaced apart from each other when supported by the rack so as to not damage each other. The system can be modular or modularly expanded to grow with the woodworker such that when the woodworker acquires more router bits, the system can add more racks and support bases to ensure there is adequate room for storing and displaying the woodworker's additional router bits.

In one aspect, one exemplary embodiment of the present disclosure may provide a router bit storage system comprising: a rack having a first end and a second end defining a lateral direction therebetween, the rack defining a channel that is aligned in the lateral direction; a support base disposed within the channel; and a router bit carried by the support base. This exemplary embodiment or another exemplary embodiment may further provide a plurality of support bases, wherein the support base is one of the plurality of support bases; and each support base in the plurality of support bases defining at least one aperture adapted to receive a shaft of one router bit. This exemplary embodiment or another exemplary embodiment may further provide a length dimension of the rack that is aligned in the lateral direction; wherein a number of support bases composing the plurality support bases depends on the length dimension of the rack; wherein when the length dimension of the rack is in a range from seven inches to nine inches, the number of support bases is in a range from four support bases to eight support bases; wherein when the length dimension of the rack is in a range from fifteen inches to about twenty-one inches, the number of support bases is in a range from ten support bases to fourteen support bases; and wherein when the length dimension of the rank is in a range from twenty-four inches to about thirty inches, the number of support bases is in a range from sixteen support bases to twenty support bases.

This exemplary embodiment or another exemplary embodiment may further provide a first member and a second member, wherein the first member and the second member are adapted to be connected to a support surface and extend outwardly from the support surface in a cantilevered manner. This exemplary embodiment or another exemplary embodiment may further provide a first surface and a second surface on the first member; a first surface and a second surface on the second member; wherein the channel is defined, at least partially, by the second surface on the first member and the first surface on the second member. This exemplary embodiment or another exemplary embodiment may further provide an upper planar portion adapted to be connected to a support surface; a central planar portion coupled to the upper planar portion; an angle defined between the upper planar portion and the central planar portion, wherein the angle is in a range from 110° to 150°. This exemplary embodiment or another exemplary embodiment may further provide wherein the angle is 120°. This exemplary embodiment or another exemplary embodiment may further provide a first central planar portion that lies along a first plane; a second central planar portion that lies along a second plane; an intermediate portion disposed between the first central planar portion and the second planar portion, wherein the first plane is spaced apart and parallel to the second plane. This exemplary embodiment or another exemplary embodiment may further provide a first central planar portion; a second central planar portion, wherein the support base contacts second central planar portion when displaying the router bit and does not contact the first central planar portion when storing the router bit. This exemplary embodiment or another exemplary embodiment may further provide a first central planar portion; a second central planar portion; and a frontal planar portion that is orthogonal to the second central planar portion, wherein the support base contacts the frontal planar portion and the second central planar portion when storing the router bit. This exemplary embodiment or another exemplary embodiment may further provide a first member including a first front edge; a second member including a second front edge; an opening defined between the first front edge and the second front edge, wherein the opening is in open communication with the channel, wherein a shaft on the router bit extends through the opening when the support base is within the channel. This exemplary embodiment or another exemplary embodiment may further provide a first central planar portion; a second central planar portion terminating at a lower front edge; an intermediate portion disposed between the first central planar portion and the second planar portion; wherein a width dimension of the support base is greater than a dimension of the second central planar portion measured from the lower front edge to the intermediate portion. This exemplary embodiment or another exemplary embodiment may further provide a first member including a vertically aligned upper planar portion, a central planar portion, a frontal planar portion, and a lower planar portion; and a second member disposed below the first member. This exemplary embodiment or another exemplary embodiment may further provide a first bend between the vertically aligned upper planar portion and the central planar portion, wherein the first bend defines an angle between the vertically aligned upper planar portion and the central planar portion, and the angle is in a range from 110° to 150°. This exemplary embodiment or another exemplary embodiment may further provide a second bend between the central planar portion and the frontal planar portion, wherein the second bend defines a second angle between the central planar portion and the frontal planar portion, and the second angle is in a range from 150° to 175°. This exemplary embodiment or another exemplary embodiment may further provide an upper rear corner on the support base; wherein the upper rear corner on the support base contacts the lower planar portion of the first member when the support base is disposed within the channel.

In another aspect, another exemplary embodiment of the present disclosure may provide a router bit storage system sold as a kit, the kit comprising: a rack defining a channel aligned in a lateral direction; a length dimension of the rack that is aligned in the lateral direction; a plurality of support bases sized to be received within the channel and adapted to carry a router bit thereon; and wherein a number of support bases within the kit composing the plurality support bases depends on the length dimension of the rack. This exemplary embodiment or another exemplary embodiment may further provide wherein the length dimension of the rack is in a range from seven inches to nine inches, and the number of support bases is in a range from four support bases to eight support bases. This exemplary embodiment or another exemplary embodiment may further provide wherein the length dimension of the rack is in a range from fifteen inches to about twenty-one inches, and the number of support bases is in a range from ten support bases to fourteen support bases. This exemplary embodiment or another exemplary embodiment may further provide wherein the length dimension of the rank is in a range from twenty-four inches to about thirty inches, and the number of support bases is in a range from sixteen support bases to twenty support bases.

In yet another aspect, another exemplary embodiment of the present disclosure may provide a rack for storing items thereon, the rack comprising: a first side and a second side defining a lateral direction therebetween, a top and a bottom defining a vertical direction therebetween, and a front end and a rear end defining a transverse direction therebetween; a first member having a maximum dimension aligned in the lateral direction: a second member having a maximum dimension aligned in the lateral direction; a channel defined between the first member and the second member, wherein the channel is aligned in the lateral direction and adapted to store items therein; and wherein the rack is adapted to be connected to a support surface and extend outwardly and downwardly from the support surface in a cantilevered manner. This exemplary embodiment or another exemplary embodiment may further provide a first surface and a second surface on the first member; a first surface and a second surface on the second member; wherein the channel is defined, at least partially, by the second surface on the first member and the first surface on the second member. This exemplary embodiment or another exemplary embodiment may further provide an upper planar portion adapted to be connected to a support surface; a central planar portion coupled to the upper planar portion; an angle defined between the upper planar portion and the central planar portion, wherein the angle is in a range from 110° to 150°. This exemplary embodiment or another exemplary embodiment may further provide wherein the angle is 120°. This exemplary embodiment or another exemplary embodiment may further provide a first central planar portion that lies along a first plane; a second central planar portion that lies along a second plane; an intermediate portion disposed between the first central planar portion and the second planar portion, wherein the first plane is spaced apart and parallel to the second plane. This exemplary embodiment or another exemplary embodiment may further provide a first central planar portion; a second central planar portion, wherein the second central planar portion is adapted to contact a support base when displaying the item and the first central planar portion adapted to not contact the support base when displaying the item. This exemplary embodiment or another exemplary embodiment may further provide a first central planar portion; a second central planar portion; and a frontal planar portion that is orthogonal to the central planar portion, wherein the frontal planar portion is adapted to contact a support base contacts when displaying the item. This exemplary embodiment or another exemplary embodiment may further provide a first member including a first front edge; a second member including a second front edge; an opening defined between the first front edge and the second front edge, wherein the opening is in open communication with the channel, wherein the opening is adapted to allow the item to extend through the opening. This exemplary embodiment or another exemplary embodiment may further provide a first central planar portion; a second central planar portion terminating at a lower front edge; an intermediate portion disposed between the first central planar portion and the second planar portion. This exemplary embodiment or another exemplary embodiment may further provide a first member including a vertically aligned upper planar portion, a central planar portion, a frontal planar portion, and a lower planar portion; and a second member disposed below the first member. This exemplary embodiment or another exemplary embodiment may further provide a first bend between the vertically aligned upper planar portion and the central planar portion, wherein the first bend defines an angle between the vertically aligned upper planar portion and the central planar portion, and the angle is in a range from 110° to 150°. This exemplary embodiment or another exemplary embodiment may further provide a second bend between the central planar portion and the frontal planar portion, wherein the second bend defines a second angle between the central planar portion and the frontal planar portion, and the second angle is in a range from a range from 150° to about 175°. This exemplary embodiment or another exemplary embodiment may further provide a terminal end of the lower planar portion disposed directly below the second bend. This exemplary embodiment or another exemplary embodiment may further provide a first member; and a second member disposed below the first member, wherein the second member includes an upper planar portion, a first central planar portion, a second central planar portion, an intermediate portion between the first central planar portion and the second central planar portion, and a frontal planar portion. This exemplary embodiment or another exemplary embodiment may further provide a first bend between the upper planar portion and the first central planar portion, wherein the first bend defines an angle between the upper planar portion and the first central planar portion, and the angle is in a range from 110° to 150°. This exemplary embodiment or another exemplary embodiment may further provide a first bend between the first central planar portion and the intermediate portion. This exemplary embodiment or another exemplary embodiment may further provide a third bend between the intermediate portion and the second central planar portion. This exemplary embodiment or another exemplary embodiment may further provide wherein the frontal planar portion is orthogonal to the second central planar portion. This exemplary embodiment or another exemplary embodiment may further provide a first member; and a second member comprising first and second extension that extend rearward from a frontal surface of the second member at each side of the rack. This exemplary embodiment or another exemplary embodiment may further provide an opening to the channel defined between the first and second extensions on the second member.

In yet another aspect, another exemplary embodiment of the present disclosure may provide a method of removing a router bit from a router bit storage rack, the method comprising: grasping a router bit carried by a support base in a channel defined in a router bit storage rack; pivoting the router bit and support base in unison about a pivot point defined by the router bit storage rack; and lifting the router bit and support base in unison out of the channel. This exemplary embodiment or another exemplary embodiment may further provide grasping the router bit by a shaft of the router bit, wherein the shaft extends through an opening to the channel on the router bit storage rack. This exemplary embodiment or another exemplary embodiment may further provide moving the support base rearward towards a rear support surface while pivoting the router bit and support base in unison. This exemplary embodiment or another exemplary embodiment may further provide contacting a lower rear corner of the support base with a first surface of a lower portion of the router bit storage rack while moving the support base rearward. This exemplary embodiment or another exemplary embodiment may further provide detaching an upper rear corner of the support base from contact with a lower surface of an upper portion of the router bit storage rack in response to pivoting the router bit and support base in unison. This exemplary embodiment or another exemplary embodiment may further provide lifting the router bit and support base in unison out of the channel through an opening to the channel, wherein the opening is defined between a first member and a second member of the router bit storage rack. This exemplary embodiment or another exemplary embodiment may further provide flexing a portion of the router bit storage rack in response to pivoting the router bit and support base in unison. This exemplary embodiment or another exemplary embodiment may further provide removing the support base and router bit from the router bit storage rack; placing the support base on another support surface; and maintaining the router bit in a vertical position that is accomplished by the support base having a cuboid configuration. This exemplary embodiment or another exemplary embodiment may further provide disconnecting the router bit from the support base. This exemplary embodiment or another exemplary embodiment may further provide wherein disconnecting the router bit from the support base is accomplished by grasping a shaft of the router bit and applying an upward vertical force that is greater than a spring force exerted by spring fingers on the support base that are biased against the shaft.

In yet another aspect, another exemplary embodiment of the present disclosure may provide a method of removing a router bit from a router bit storage rack, the method comprising: grasping a router bit carried by a support base in a channel defined in a router bit storage rack; disconnecting the router bit from the support base that is accomplished by grasping a shaft of the router bit and applying an upward vertical force that is greater than a spring force exerted by spring fingers on the support base that are biased against the shaft; and retaining the support base within the channel after disconnecting the router bit from the support base.

In yet another aspect, another exemplary embodiment of the present disclosure may provide a method of installing a router bit on a router bit storage rack, the method comprising: connecting a router bit to a support base; grasping the router bit or the support base to move the router bit and support base in unison; inserting the router bit and support base into a channel defined in a router bit storage rack; releasing the router bit to retain the support base and router bit in the channel of the router bit storage rack, wherein a shaft of the router bit extend through an opening to the channel. This exemplary embodiment or another exemplary embodiment may further provide grasping the shaft of the router bit; applying a force to the shaft of the router bit that is greater than and overcomes a spring force exerted by spring fingers on the support base that are biased against the shaft. This exemplary embodiment or another exemplary embodiment may further provide wherein inserting the router bit and support base into the channel is accomplished by: sliding the support base laterally through a slot into the channel, wherein the slot is defined between a first edge on a first portion of the router bit storage rack and a second edge on a second portion of the router bit storage rack. This exemplary embodiment or another exemplary embodiment may further provide wherein inserting the router bit and support base into the channel is accomplished by: tilting the router bit and support base in unison to a more vertical position; pushing the router bit and support base rearward toward a rear support surface to which the router bit storage rack is mounted; moving the router bit and support base through an opening to the channel; pivoting the router bit and support base in unison about a pivot point defined by the router bit storage rack; and disposing the support base in the channel and positioning the shaft of the router bit through the opening to the channel.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
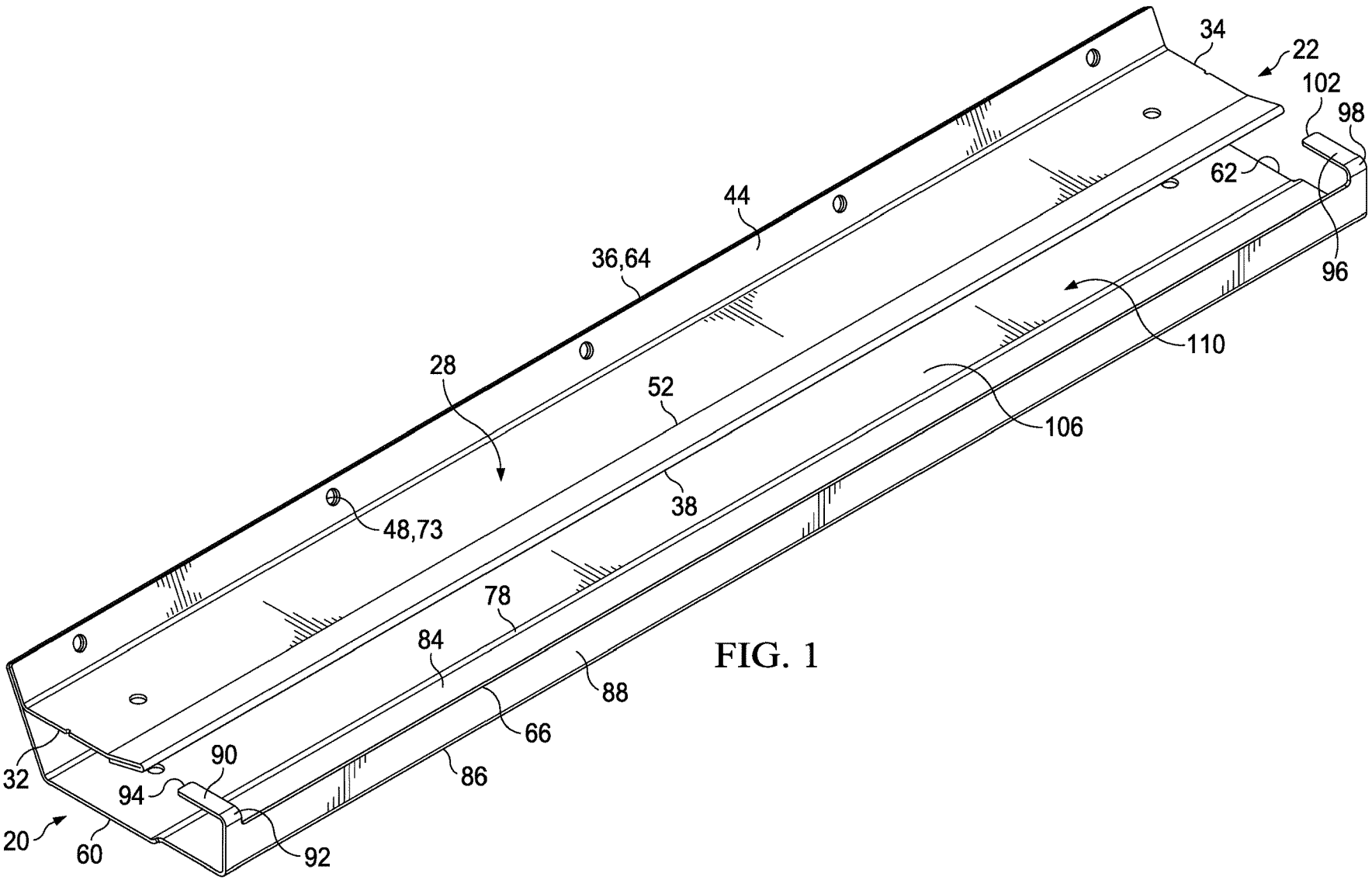
FIG. 1 is a top first side perspective view a rack for supporting items thereon according to one exemplary aspect of the present disclosure.

A rack for supporting items is depicted throughout the Figures generally at 10. Rack 10 is intended to support items associated with woodworking tools, however any item that fits on rack 10 may be supported by the same. In one example, rack 10 supports woodworking a router bit 12 carried by a support base 14 that is slidably received in a portion of rack 10. There may be a plurality of router bits 12, wherein the router bits may be similar, different, or some similar and some different. Further, the support base 14 that is supported by rack 10 may be one of a plurality support bases 14. In one preferred example, one support base 14 carries one router bit 12, however it is possible, though not preferred, for one support base 14 to carry multiple router bits 12. The support base 14 may also be known as a support block 14 or a bit block 14. Collectively, the rack 10 and the plurality of support bases 14 may define a router bit storage system 100 for one or more router bits 12.

Rack 10 includes a top 16 opposite a bottom 18 defining a vertical direction therebetween. Rack 10 includes a first side 20 opposite a second side 22 defining a lateral direction therebetween, and the lateral direction is perpendicular to the vertical direction. Rack 10 includes a front side 24 opposite a rear side 26 defining a transverse direction therebetween, and the transverse direction is perpendicular to the vertical direction and perpendicular the lateral direction. The front side 24 extends between the first side 20 and the second side 22. The rear side 26 extends between the first side 20 and the second side 24. The first side 20 and the second side 22 extend between the front side 24 and the rear side 26.

In one exemplary embodiment, rack 10 may include (i) a first member 28 or upper portion 28 and (ii) a second member 30 or lower portion 30, which are coupled together to collectively compose rack 10. Each of the first member 28 and second member 30 may be formed from a distinct body. Each one of the bodies forming the first member 28 and second member 30 may be a unibody that is integrally extruded, molded, printed, or additively manufactured, removably machined, or formed as a unitary, monolithic member substantially fabricated from a rigid, manmade, material. In one example, metal or metal alloys, such as stainless steel or aluminum alloy, may form a substantial majority of the components or elements used to fabricate each body of the first member 28 and second member 30, and their various components integrally formed, molded, or extruded therewith. Each rigid body of the first member 28 and second member 30 should withstand typical woodworking forces or handling from an operator grasping woodworking tools supported by the bodies defining rack 10. While it is contemplated that each body of the first member 28 and second member 30 and their additional components described herein are uniformly and integrally extruded, molded, or formed, it is entirely possible that the components of each body be formed separately from alternative materials as one having routine skill in the art would understand. In another example, the body may be formed from an elastomeric material or rubber material configured to withstand slight deformation upon impact or bending by the operator (i.e., a woodworker). Furthermore, while the components of each body are discussed below individually, it is to be clearly understood that the components and their corresponding reference elements of the tool body are portions, regions, or surfaces of the body and all form a respective element or component of the unitary body. Thus, while the components may be discussed individually and identified relative to other elements or components of the body, in this exemplary embodiment, there is a single body of each the first member 28 and the second member 30 having the below described portions, regions, or surfaces. Alternatively, the first member 28 (or upper portion) and the second member 28 (or lower portion) may be formed as single unitary unibody device that defines a rack, rather than as two distinct pieces each having their own respective body. Other terms may be used with respect to each of the first member 28 and the second member 30 without departing form the scope of the present disclosures. For example, each of these members may be referred to as brackets (i.e., first and second brackets), shelves (i.e., first and second shelves), ledges (i.e., first and second ledges), or the like. Additionally, it is contemplated that the rack 10 will be provided to a consumer as a single fully assembly piece with first member 28 and second member 30 fixedly connected together through either welding or adhesive, however, it is possible that that they may be provided as separate components for final assembly to be completed by the woodworker or user.

Figure 2:
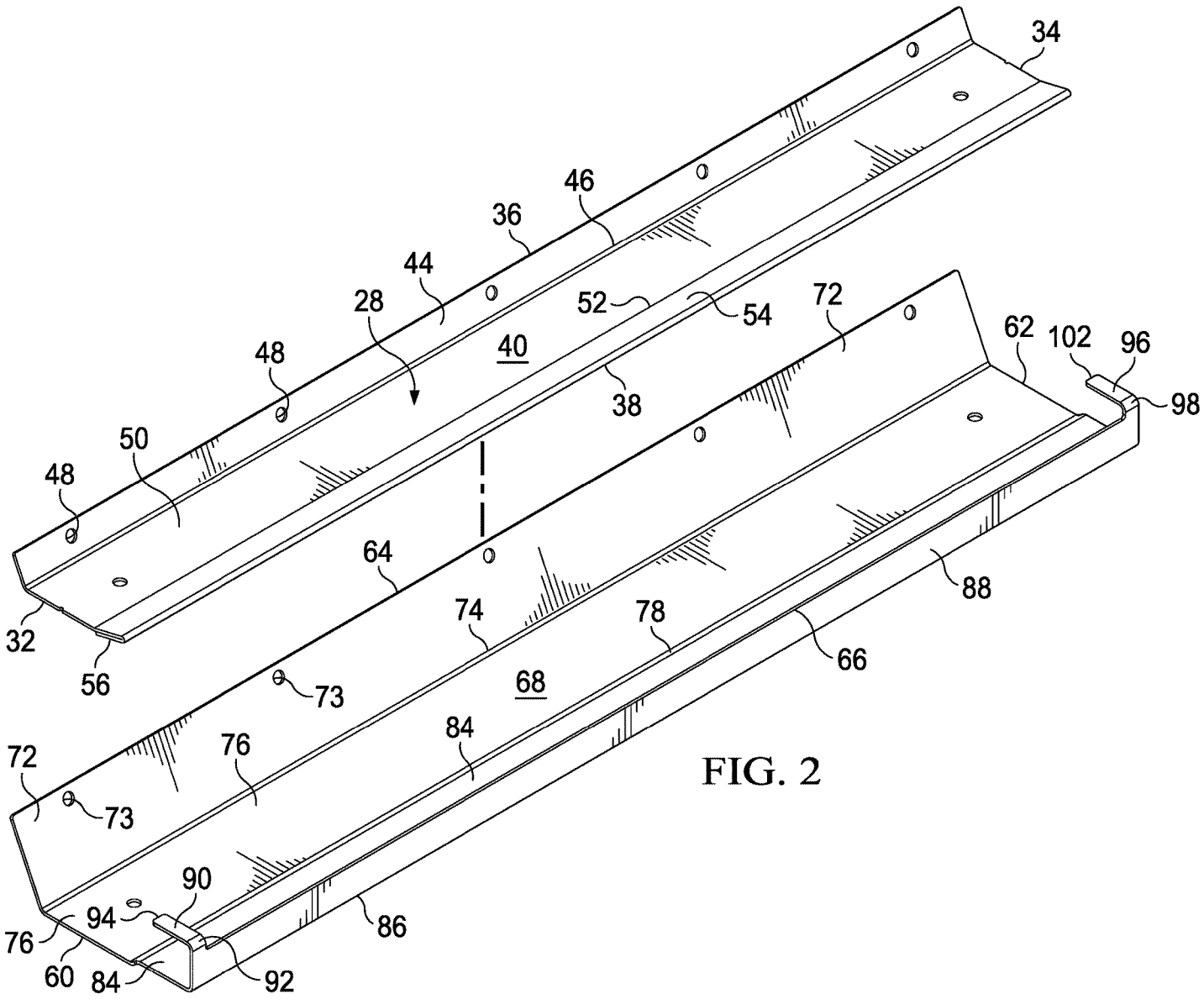
FIG. 2 is an exploded top first side perspective view the rack for supporting items thereon.

FIG. 1 and FIG. 2 depict that the first member 28 includes a first side edge 32 and a second side edge 34. A length of the first member 28 extends in the lateral direction and the length is the dimension between the first side edge 32 and the second side edge 34. The length of first member 28 may be its maximum dimension. Stated otherwise, the length of the first member 28 is greater than its width and greater than its height. A top edge 36 extends laterally between the first side edge 32 and the second side edge 34. A front edge 38 of first member 28 extends between the first side edge 32 and the second side edge 34. A first surface 40 of the first member 28 is bound by the first side edge 32, the second side edge 34, the top edge 36, and the front edge 38. First surface 40 of first member 28 may also be referred to as an upper surface of the first member 28. The first member 28 includes a second surface 42 that is opposite the first surface 40.

First member 28 includes an upper vertically aligned planar portion 44 that extends fully between the first side edge 32 and the second side edge 34. Upper planar portion 44 extends vertically from top edge 36 to a laterally extending first bend 46, wherein the bend 16 defines a concave corner formed in the first surface 40. The upper portion 44 may further define one or more apertures 48 extending transversely through the upper planar portion 44 from the first surface 40 to the second surface 42. In one particular embodiment, the plurality of apertures formed in the upper planar portion are spaced apart at regular intervals and are sized to receive a screw or bolt therethrough such that the rack 10 may be mounted to a support surface.

Figure 3:
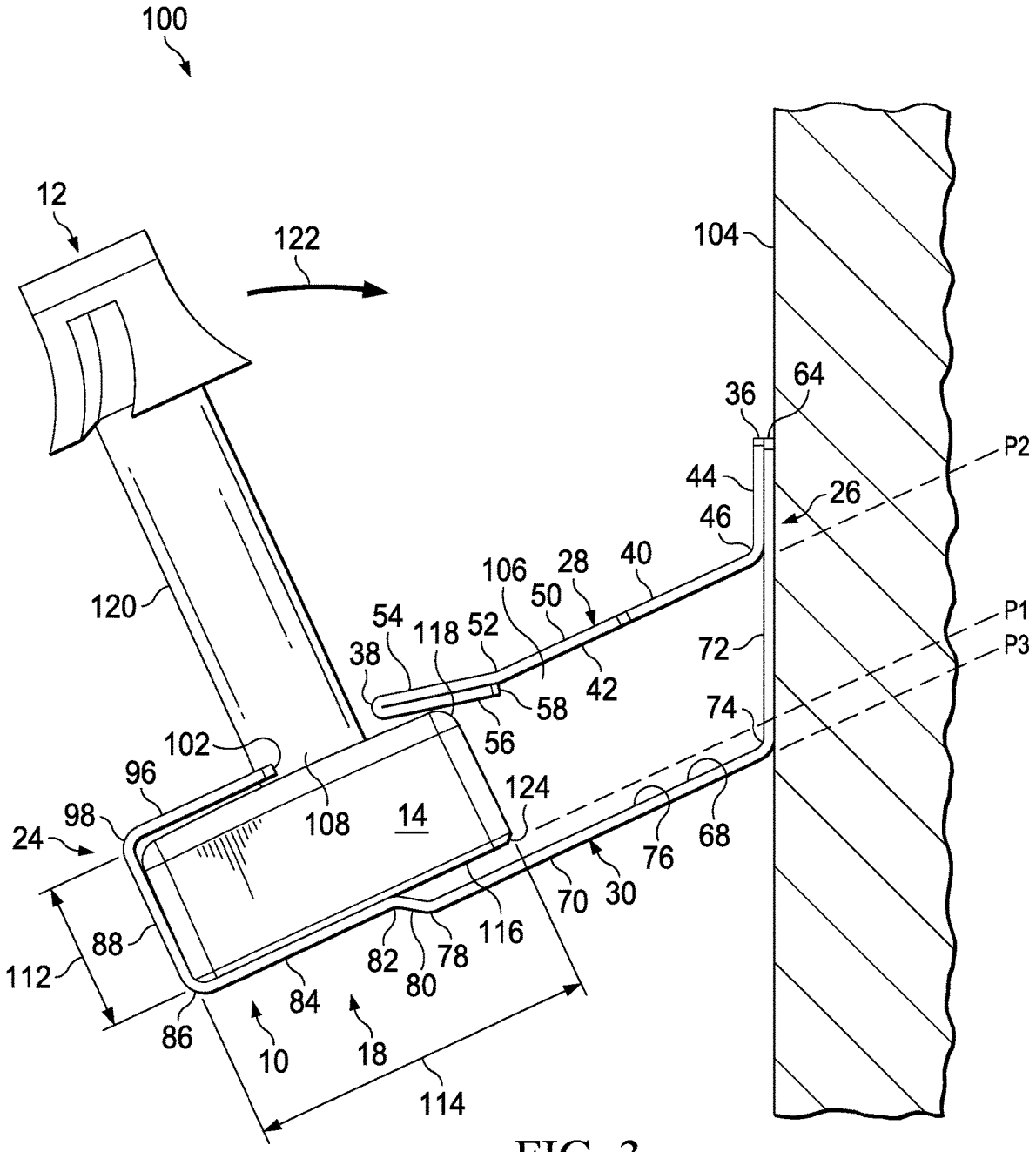
FIG. 3 is a second side elevation view of the rack supporting a support base carrying an exemplary item, namely, an exemplary router bit.

First portion 28 additionally includes a central planar portion 50 that extends laterally between the first side edge 32 and the second side edge 34. Central planar portion 50 extends downwardly from the first bend 46 to a second bend 52. Second bend 52 extends laterally between first side edge 32 and second side edge 34. Second bend 52 is located vertically below first bend 46. As such, the central planar portion 50 is bound between first bend 46, second bend 52, and the first and second side edges 32, 34. Central planar portion 50 projects downwardly from the upper planar portion 44 and outwardly from the upper planar portion 44 when viewed from either the first side 32 or the second side 34 as shown in FIG. 3.

First member 28 includes a frontal planar portion 54 extending laterally between the first side edge 32 and the second side edge 34 between the second bend 52 and the front edge 38. The frontal planar portion extends outwardly and slightly upwardly from the central planar portion 50. As such, the front edge 38 is positioned slightly vertically higher than the second bend 52.

The angles at which the first bend 46 and second bend 52 are angled may vary depending on an exemplary application and the sizes of the support bases 14 that are to be supported by the rack. However, in one exemplary embodiment, the angle at the first bend 46 between the upper planar portion 44 and the central planar portion 50 is in a range from 100° to 140°. In one specific embodiment, the angle of the first surface 40 between the upper planar portion 44 and the central planar portion 50 is 120°. The 120° angle at first bend 46 can ensure that the central planar portion 50 projects downwardly from the upper planar portion 44 and outwardly from the support surface 104 to which the rack 10 is mounted. A second angle is defined at the second bend 52 between the central planar portion 50 and the frontal planar portion 54. The angle on the first surface 40 between the central planar portion 50 and the frontal planar portion 54 is in a range from 150° to about 175°. In one particular embodiment, the angle defined by second bend 52 is in a range between 160° and 170°. In one specific embodiment, the angle defined by second bend 52 is 165° between the central planar portion 50 and the frontal planar portion 54.

First member 28 may additionally include a lower planar portion 56 that extends laterally between the first side edge 32 and the second side edge 34. Lower planar portion 56 is disposed below the frontal planar portion 54 and extends from the frontal edge 38 transversely towards the support surface 104 to a terminal edge 58. In one particular embodiment, terminal edge 58 is disposed vertically below second bend 52. Inasmuch as the first member 28 is formed as a unibody member, the first surface 40 of first member 28 extends around the frontal edge 38 approximately 180° and is defined by a front lateral 180° bend defining the frontal edge 38 such that the first surface 40 faces an opposite direction at the lower planar portion 56 than the first surface 40 faces on the frontal planar portion 54. Surface 40 at the lower planar portion 56 is configured to engage a portion of the support base 14 as will be described in greater detail below.

With continued reference to FIG. 1-FIG. 3, second member 30 includes a first side edge 60 and a second side edge 62. The length dimension of the second member 30 is aligned in the lateral direction and extends between first side edge 60 and second side edge 62. The length of second member 30 may be its maximum dimension. Stated otherwise, the length of the second member 30 is greater than its width and greater than its height. In one particular embodiment, the length dimension of the second member 30 equals the length dimension of the first member 28. However, it is certainly possible for the first member 28 and the second member 30 to have differing lengths aligned in the lateral direction. Second member 30 includes a top edge 64 extending between the first side edge 60 and the second side edge 62. The second member 30 includes a front edge 66 extending at least partially between the first and second side edges 60, 62. A first surface 68 is bound between the first and second side edges 60, 62 and the top edge 64 and the front edge 66. Opposite the first surface 68 is a second surface 70.

Second member 30 includes an upper planar portion 72 that is defined and bound by the top edge 64 and extends fully between the first side edge 60 and the second side edge 62. Upper planar portion 72 extends downwardly from the top edge 64 to a first bend 74. First bend 74 extends fully between the first side edge 60 and the second side edge 62. The vertical height or vertical dimension of the upper planar portion 72 between the top edge 64 and the first bend 74 is greater than the vertical dimension on the first member 28 between its top edge 36 and its first bend 46. As such, the vertical height or vertical dimension of the upper planar portion 72 is greater than that of the upper planar portion 44 on first member 28. First bend 74 creates a convex surface along first bend 74 in first surface 68 on the second member 30. Upper planar portion 72 defines a plurality of apertures 73 that extend transversely through the upper planar portion 72 from the first surface 68 to the second surface 70.

Second member 30 includes a first central planar portion 76 that extends from first bend 74 to a second bend 78. First central planar portion 76 on the second member 30 extends between the first side edge 60 and the second side edge 62 between first bend 74 and second bend 78. The angle at which the first central planar portion 76 is oriented relative to the upper planar portion 72 is equal to that of the angle between the upper planar portion 44 and the central planar portion 50 on first member 28. As such, first central planar portion 76 is parallel in cross section to central planar portion 50 on first member 28. Due to the parallel spaced apart relationship between first central planar portion 76 and central planar portion 50, the first central planar portion 76 extends downwardly from first bend 74 and outwardly from the upper planar portion 72 away from the support surface to which rack 10 is mounted.

Second member 30 includes an intermediate portion 80 located between second bend 78 and a third bend 82. Intermediate portion 80 is short segment that may be planar and extends upwardly from second bend 78 when viewed from the side. The intermediate portion 80 extends between first side 60 and second side edge 62 between second bend 78 and third bend 82. A second central planar portion 84 extends from the third bend 82 to a lower front edge 86. The second central planar portion 84 extends fully between the first side edge 60 and the second side edge 62 on second member 30 between third edge 82 and lower front edge 86. Because the intermediate portion 80 projects upwardly and outwardly from second bend 78, the second central planar portion 84 is offset from the first central planar portion 76. In one particular embodiment, the second central planar portion 84 is offset parallel to the first central planar portion 76 such that the angle at the third bend 82 defined between the intermediate portion 80 and the second planar portion 84 is complementary to the angle between the first central planar portion 76 and the intermediate portion 80 at the second bend 78. Stated otherwise, while the second central planar portion 84 projects downwardly and outwardly from third bend 82, the distance between the plane associated with the first surface 68 on the second central planar portion 84 is closer to the plane P2 associated with the second surface 42 than the plane P3 associated with the first surface 68 at the first central planar portion 76. Stated otherwise, plane P1 associated with surface 68 at the second central planar portion 84 is disposed between plane P2 associated with second surface 42 and plane P3 associated with surface 68 at first central planar portion 76. The vertical distance between plane P1 and plane P3 is less than the vertical distance between plane P1 and plane P2. In one particular embodiment, planes P1-P3 are all parallel and intersect support surface 104 to which rack 10 is mounted at an angle of about 120° relative to vertical.

Second member 30 includes a front wall 88 that extends vertically upward from the lower front edge 86 to the front edge 66 of second member 30. Front wall 88 is orthogonal to second central planar portion 84. At each respective side of front wall 88 near the front edge 66, there may be rear extensions that extend rearward from the front edge 66 towards the upper planar portion 72. Namely, a first rear extension 90 has a side edge that is commensurate with the first side edge 60 and projects rearward from the front edge 66 via a bend 92 and terminates at a rear terminal edge 94. Similarly, a second extension 96 has a side edge that is commensurate with the second side edge 62 and extends rearward from a bend 98 at the front edge 66 and terminates at a rear edge 102.

As depicted in FIG. 1 and FIG. 3, when the rack 10 is assembled, the first member 28 and the second member 30 are aligned such that the top edge 36 of upper planar portion 44 aligns coplanar with the top edge 64 of second member 30. The alignment of the respective top edges 36, 64 also aligns apertures 48 formed in upper planar portion 44 with apertures 73 defined in upper planar portion 72 of second member 30. The first member 28 and second member 30 may be connected to each other in any known manner utilizing mechanical means (i.e, welding or bolts), chemical means (i.e., adhesive or any chemical bonding), or any non-mechanical and non-chemical means.

From a commercial perspective, it is envisioned that rack 10 will be supplied to the consumer as preassembled such that the first member 28 is already connected to the second member 30 when rack 10 is supplied to a consumer. However, it is entirely possible that the first member 28 and the second member 30 are supplied to a consumer as separate and distinct pieces or components for assembly by the consumer (i.e., the woodworker).

A screw or bolt may then be inserted through the transversely aligned apertures 48 and 73 to mount the first member 28 and the second member 30 to the support surface 104. When the first member 28 and second member 30 are mounted to the support surface 104, they collectively define rack 10. When assembled and mounted together as shown in FIG. 1 and FIG. 3, a channel 106 is defined between the first member 28 and the second member 30. The channel 106 is bound near its upper end by second surface 42 of first member 28 and is bound at its lower end by the first surface 68 of the second member 30. Channel 106 is bound at its rear end by surface 68 on the upper planar portion 72 of second member 30. The frontal portion of channel 106 is bound by surface 68 on the front wall 88 of second member 30.

When rack 10 is assembled, a slot 108 that defines an opening to channel 106 is defined between the rear edge 102 of the second extension 96 and the front edge 38 on first member 28. The slot 108 has a width dimension defined between edge 102 and edge 38. The width of slot 108 is a smaller dimension than the dimension of an opening 110 to the channel 106, wherein the opening 110 is defined between the front edge 38 on first member 28 and the front edge 66 on second member 30.

FIG. 3 depicts that the rack 10 may be installed on the support surface in a cantilevered manner such that the first support member 28 and second support member 30 extend outwardly from the support surface 104. Support surface 104 may be any structure configured to provide sufficient rigidity and strength to support the weighted items, such as router bits 12, thereon. In one particular embodiment, support surface 104 is a wall and in another embodiment, it is a surface of a router table. Either would suffice as a support surface 104 so long as the woodworker using the rack 10 has sufficient access and ease of display for viewing the router bits that are needed for a woodworking operation.

With continued reference to FIG. 3, each support base 14 or support block that carries one or more router bits is generally cubed shaped. Stated otherwise, each support base 14 or support block may have cuboid configuration. An exemplary cuboid support base 14 or support block is a convex polyhedron bounded by six quadrilateral faces, in which each of the faces is a rectangle or generally rectangular (and so each pair of adjacent faces meets in a right angle). Exemplary shapes or configurations of the support base or support block may be a rectangular cuboid, right cuboid, rectangular box, rectangular hexahedron, right rectangular prism, or rectangular parallelepiped.

Figure 4:
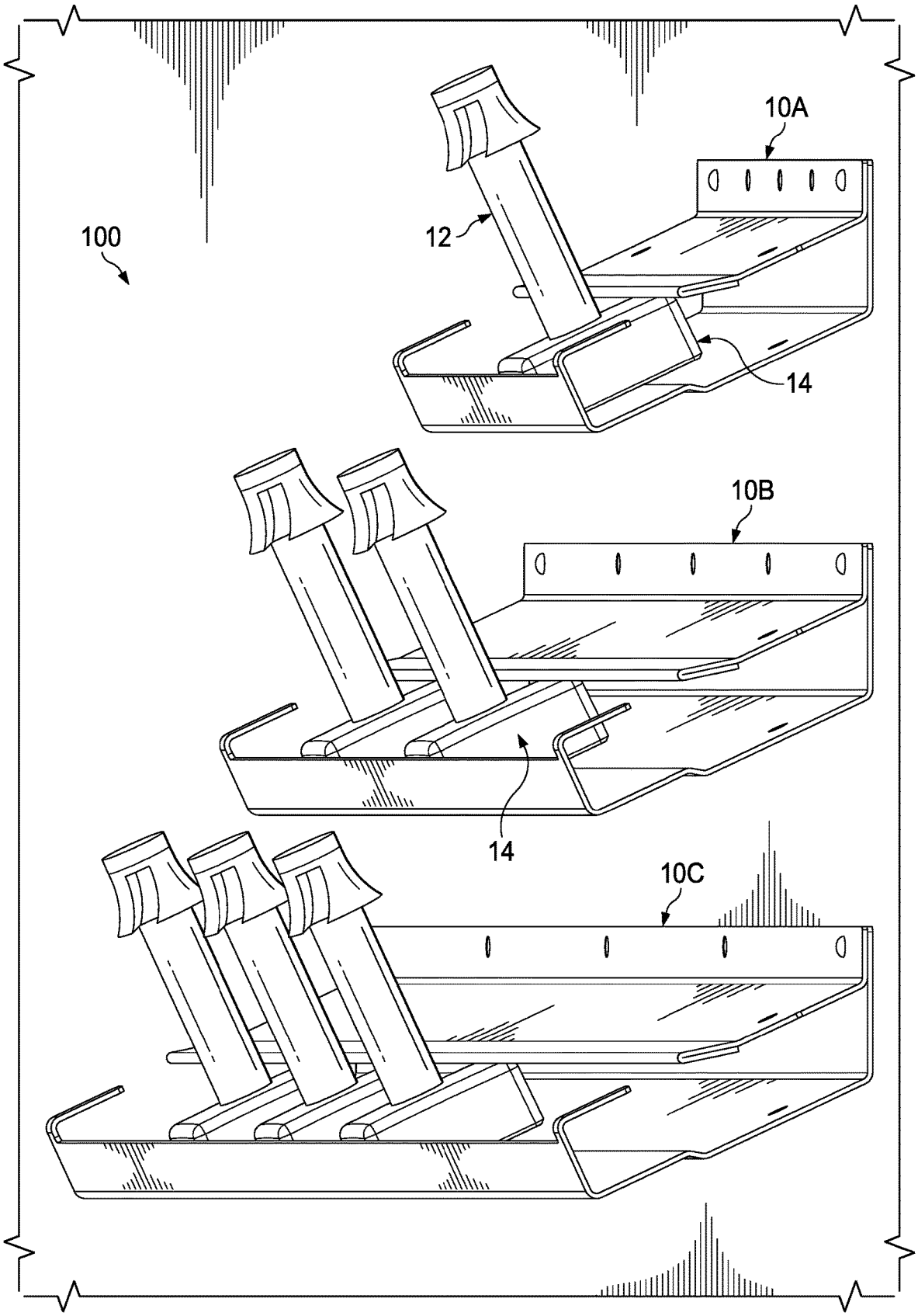
FIG. 4 is a second side perspective view of a plurality of racks having differing lengths, each mounted to a surface, that depicts the modularity of a system composed of differing racks and support bases to carry items thereon according to an exemplary aspect of the present disclosure.
Figure 5:
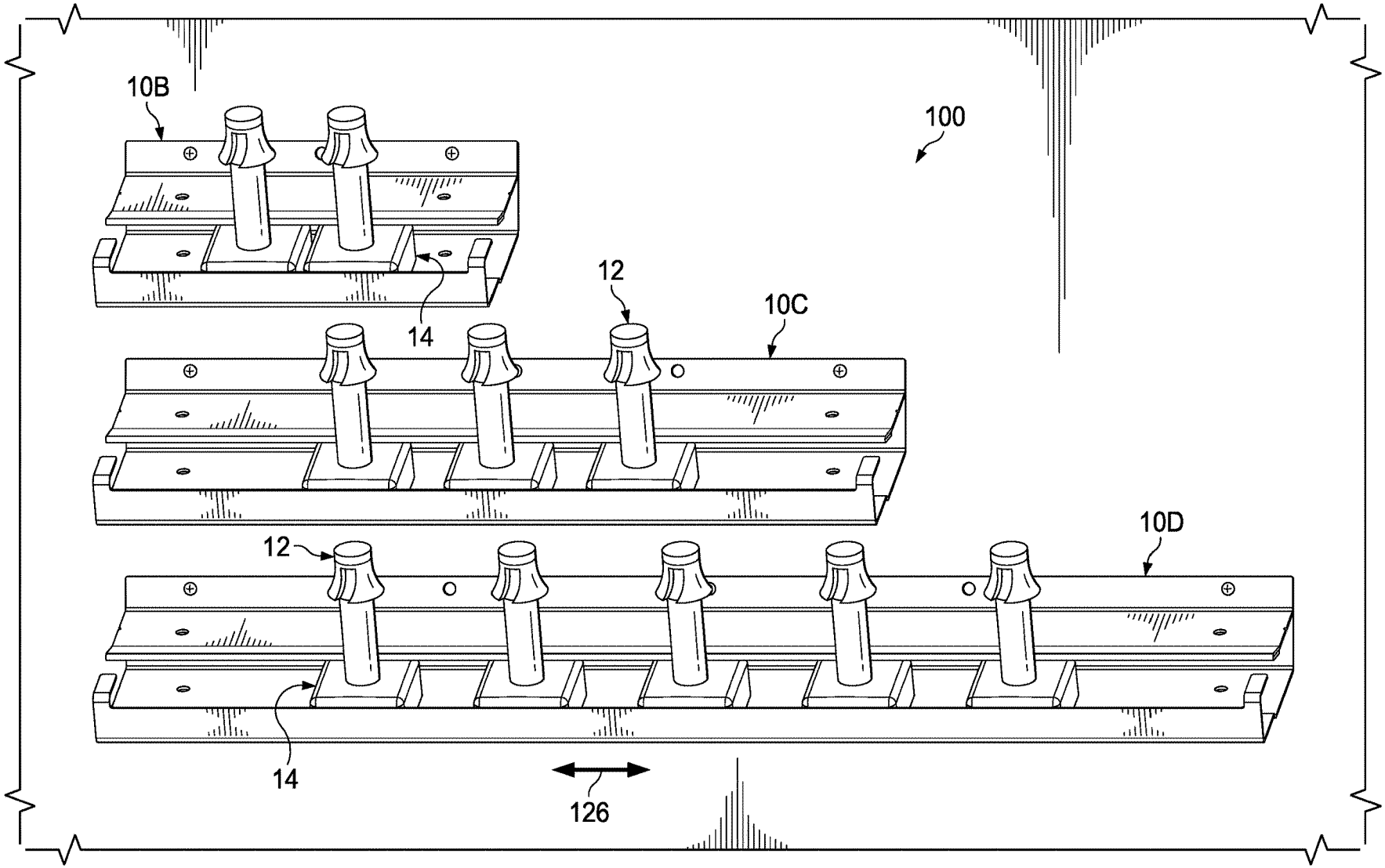
FIG. 5 is a front perspective view of the plurality of racks having differing lengths, each mounted to the surface, that depicts the modularity of the system composed of differing racks and support bases to carry items thereon according to an exemplary aspect of the present disclosure.

FIG. 3 depicts that when rack 10 is assembled, the height dimension of the support base 14 is similar to or closely approximates dimension 112 measured from plane P1 associated with the second central planar portion 84 to the second extension 96. A width dimension 114 of support base 14 is greater than the distance of the second central planar portion 84 between the lower front edge 86 and the third bend 82. As such, only a portion of a lower surface 116 contacts first surface 68 at the second central portion 84. The rear portion of lower surface 116 of support base 14 overhangs the intermediate portion 80 and overhangs the first central planar portion 76 when the support base 14 contacts front wall 88. An upper rear corner 118 of support base 14 contacts the lower planar portion 56 of the first member 28 to secure the support base 14 in a desired location in channel 106. As such, when the support base 14 is installed on the rack in a display position as shown in FIG. 3 and FIG. 4 and FIG. 5, the support base 14 contacts rack 10 at least three locations. Namely, the support base 14 contacts rack 10 at the front wall 88, the second central planar portion 84, and the upper corner 118 of the support base 14 contacts the lower planar portion 56.

The unique configuration of how support base 14 is supported by rack 10 enables the display of an item, such as router bit 12, to be carried by the support base 14 and the shank or shaft 120 of the bit 12 extends upwardly and outwardly from support surface 104 for display while rack 10 is mounted on the support surface 104. Particularly, the shaft 120 of router bit 12 is received within an aperture or a well that is formed in the support base 14 to allow it to extend upwardly and outwardly in a cantilevered manner for display.

One exemplary configuration of a support base 14 for supporting the router bits 12 is shown in co-owned U.S. Design patent application Ser. No. 29/824,451, having the same priority date herewith, entitled BASE FOR SUPPORTING ROUTER BITS, the entirety of which is incorporated herein by reference. An aperture that receives the router bit 12 is formed in supported base 14. The aperture in the support base 14 accepts both half inch and quarter inch shanks or shafts 120 on each respective router bit 12. Each support base 14 defines the aperture or recess extending vertically through the base 14 from its top surface to its bottom surface. Each aperture is defined by a pair of spring fingers. A first pair of spring fingers is configured to hold a quarter inch shank router bit whereas a second set or second pair of spring fingers is configured to hold a half inch shank router bit. Thus, a single base 14 can be used to support and carry different size router bits in the system 100. The spring fingers maintain the router bit in a locked position even if the base is turned upside down when it is removed from the rack.

In one exemplary embodiment of the present disclosure, the width of slot 108 is a greater dimension than the width of the shaft 120 to enable lateral movement of the router bits through slot 108 and facilitating the sliding of bases 14 laterally into and out of the channel 106. In another exemplary embodiment, the dimension of the slot 108 between edge 102 and edge 138 is less than the width dimension of the shaft 120 on the router bit 12 to preclude lateral movement from the router bits sliding laterally out of the channel 106.

FIG. 4 and FIG. 5 depict the modular configuration of system 100. System 10 may be formed from a plurality of different racks 10 each having a different length. For example, rack 10A may have a shortened lateral length such that it supports only a single base 14 carrying one router bit 12. When a user or woodworker gains or acquires more than one router bit, there may be a need to have another rack capable of storing more than one router bit and associated base. For example, a second rack 10B may be added to the system 100 that has a greater lateral length dimension than the first rack 10A, wherein the second rack 10B is sized to carry two or more support bases 14 each with their own router bit 12. The system 100 is modularly expandable to any number of racks having any lateral length dimensions as shown. For example, a third rack 10C may carry three support bases each having their own router bit 12, whereas a fourth rack 10D is even laterally longer carrying five or more support bases 14 each with their own router bit 12.

The length dimension of the rack 10 is measured from its first end 20 to its second end 22 is nine inches and determines how many support bases 10 can be carried by the rack 10. If the rack 10 has a length that is in a range from about seven inches to about eleven inches, then there may be a number of support bases composing the plurality of support bases that is in a range from four support bases to eight support bases. In one particular embodiment, the lateral dimension or length of the rack 10 measured from its first end 20 to its second end 22 is nine inches. For a nine-inch rack, it may accommodate six support bases. Thus, system 100 may provide a nine inch rack 10 with six support bases 14 sold as one kit, or in combination with each other.

Another exemplary rack 10 has a length that is in a range from about fifteen inches to about twenty-one inches, then there may be a number of support bases composing the plurality of support bases that is in a range from ten support bases to fourteen support bases. Another exemplary length of rack 10 is an eighteen inch rack that can store up to twelve support bases 14. Thus, system 100 may provide an eighteen inch rack 10 with twelve support bases 14 sold as one kit, or in combination with each other.

Another exemplary rack 10 has a length that is in a range from about twenty-four inches to about thirty inches, then there may be a number of support bases composing the plurality of support bases that is in a range from sixteen support bases to twenty support bases. Another embodiment may provide a twenty-seven inch rack that can accommodate and store up to eighteen support bases 14. Thus, system 100 may provide a twenty-seven inch rack 10 with eighteen support bases 14 sold as one kit, or in combination with each other.

There may be criticality to the ranges discussed herein corresponding to the length of the rack 10 and the number of support bases 14. Particularly, the inventors have purposefully recognized and selected the claimed ranges based on the size of router bits 12 such that system 100 is a purposeful design choice that takes into consideration the size of the router bits 12, as well as the size of the rack 10 and bases 14 that are needed to adequately support said bits 12 on rack 10 via bases 14.

As shown in FIG. 4 and FIG. 5, the support bases 14 can be slid laterally along the length of each respective rack within channel 106 as indicated by arrow 126. The sliding of the support bases 14 within channel 106 enables a user to selectively set their preference of how far to laterally space support bases from each other on each respective rack. For example, in the second rack 10B, the support bases 14 are spaced close to one another, whereas in the fourth rack 10D, the support bases 14 are spaced further apart from each other relative to the lateral direction. Further, the support bases 14 that are supported by rack 10 may contact each other (i.e., such that there is no spaced between abutting support bases) but are large enough or wide enough so that the heads of each route bit 12 do not touch each other.

Given that the support bases 14 are slidably received or slidable (i.e., capable of sliding) within the channel 106, the system of the present disclosure enables an operator great flexibility to slidably adjust and rearrange the lateral position of router bits on the rack so as to reorganize them or expand the number of bits as the woodworker acquires the same. This modularity of system 100 enables great adaptability for the user to accommodate future router bits acquired by the woodworker.

Having thus described the structural configuration of system 100 including rack 10 and support bases 14 carrying items or router bits 12, reference is now made to the operation of system 100. Inasmuch as FIG. 3-FIG. 5 depict an exemplary system 100 with bases 14 already installed and carried by rack 10, reference will first be made to the removal of router bits 12 from rack 10, and then thereafter reference will be made to the installation of router bits 12 on rack 10. However, it is to be understood that the order of operation may be reversed inasmuch as the first time that the woodworker uses system 100 will require the woodworker to first install the bits 12 and bases 14 on rack 10 before the woodworker can remove the router bits 12 from rack 10.

To remove the router bit 12 and the base 14 from the rack 10, an operator may grasp the router bit 12, preferably by the shaft 120 since the head of the router bit has sharpened edges, and pivot the router bit 12 and base 14 in unison, as shown by arrow 122, about the third bend 82 in the second member 30. Pivoting or moving the base and router bit in unison about the third bend 82 will cause the support base 14 to move rearward in the channel 106 (i.e., towards the support surface 104) such that a lower rear corner 124 will contact the first surface 68 at the first central planar portion 76. The lower corner of the support base 14 may be pushed rearward after having being pivoted in the direction of arrow 122 to release the engagement of support base 14 from the front wall 88 and the second central planar portion 84. A woodworker then may continue sliding the base rearward towards the support surface until the support base 14 may be extracted from the channel 106 through the opening 110. The user may then release the router bit 12 from its engagement with the support base 14 and perform a woodworking operation or action as desired.

During the pivoting action to remove the support base 14 from the channel 106, the first member 28 may provide slight flexibility to as to bend upwardly in response to the pivoting action to further effectuate or provide ease of removal of the support base 14 from channel 106.

When the support base 14 is removed from the rack 10, a woodworker or operator may place the support base onto another support surface such that the router bit is maintained in a vertical position such that the cutting edges do not contact the surface that the support base is placed upon so as to ensure that the cutting edges of router bit 12 remain sharp and undamaged until it is ready for use and installation on the router. This is preferential to protect the carbide cutting edges on many router bits. This also prevents an accidental drop of the router bit that could damage the router bit or the router table itself.

The router bit 12 may then be extracted from its engagement with support base 14. Removing the bit 12 from the support base 14 is accomplished by grasping the shaft 120 and applying an upward vertical force that is greater than the spring force exerted by the spring fingers that are biased against the shaft 120.

In alternative example, system 100 also provides another way to remove a router bit 12 from support base 14 by leaving support base 14 installed in channel 106 and simply extracting or pulling router bit from its connection with the support base 14. A user may vertically lift the router bit 12 from the support base 14 and the force used to extract the router bit 12 can overcome the spring force of the fingers defining the aperture of the support base while the frontal planar portion 54 and the lower planar portion 46 retain the support base in the channel by securing the upper rear corner 118 in a fixed position.

Once the router bit 12 is separated from base 14, the router bit 12 may be attached to a router or another woodworking tool. The router may use router bit 12 to perform a woodworking operation to cut a workpiece or piece of wood. Then, once the woodworking operation is completed, the router bit may be removed or detached from the router.

After the router bit 12 has been used by the router, the operator or woodworker can install the router bit 12 onto the support base 14. The shaft 120 of bit 12 can be inserted into the aperture formed into base 14 such that the pair of spring fingers grasp the shaft 120. In one example, when the shaft 120 is ¼" diameter, then the first pair of spring fingers grasp the shaft 120. When the shaft 120 is ½" diameter, then the second pair of spring fingers grasp the shaft 120.

The bit 12 and support base 14 may be reinstalled or reattached back onto the rack in at least two different ways. When the shaft 120 of the router 12 is narrower than the slot 108, the operator may slide the base 14 laterally into the channel 106 by laterally moving the shaft 120 of the router bit through the slot 108 to dispose the base 14 in the channel 106 with the base engaging front wall 88. This causes shaft 120 to extend upwardly and outwardly through opening 110 while base 14 remains within channel 106. Alternatively, the woodworker may install the support base 14 onto the rack by tilting it towards a more vertical position and inserting it or pushing it rearward through the opening 110 and sliding the support base rearward towards the support surface 104 until the front portion of the support base 14 passes over edge 66. Thereafter, the base 14 may be pivoted in a direction opposite that of arrow 122. This will cause the support base to come to rest and be angled downwardly and outwardly from the support surface.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A rack for storing items thereon, the rack comprising:

a first side and a second side defining a lateral direction therebetween, a top and a bottom defining a vertical direction therebetween, and a front end and a rear end defining a transverse direction therebetween;

a first member having a maximum dimension aligned in the lateral direction and including a vertically aligned upper planar portion, a central planar portion, a frontal planar portion, and a lower planar portion;

second member having a maximum dimension aligned in the lateral direction, wherein the second member disposed below the first member;

a channel defined between the first member and the second member, wherein the channel is aligned in the lateral direction and adapted to store items therein;

wherein the first member further includes:

a first bend between the vertically aligned upper planar portion and the central planar portion, wherein the first bend defines a first angle between the vertically aligned upper planar portion and the central planar portion, and the first angle is in a range from 110° to 150°;

a second bend between the central planar portion and the frontal planar portion, wherein the second bend defines a second angle between the central planar portion and the frontal planar portion, and the second angle is in a range from a range from 150° to about 175°;

a terminal end of the lower planar portion disposed directly below the second bend; and wherein the rack is adapted to be connected to a support surface and extend outwardly and downwardly from the support surface in a cantilevered manner.

2. The rack of claim 1, further comprising:

a first surface and a second surface on the first member;

a first surface and a second surface on the second member;

wherein the channel is defined, at least partially, by the second surface on the first member and the first surface on the second member.

3. The rack of claim 1, wherein the first angle is 120°.

4. The rack of claim 1, wherein the second member further comprises:

a first central planar portion that lies along a first plane;

a second central planar portion that lies along a second plane;

an intermediate portion disposed between the first central planar portion and the second planar portion, wherein the first plane is spaced apart and parallel to the second plane.

5. The rack of claim 1, wherein the second member further comprises:

a first central planar portion; and a second central planar portion, wherein the second central planar portion is adapted to contact a support base when displaying the item and the first central planar portion adapted to not contact the support base when displaying the item.

6. The rack of claim 1, wherein the second member further comprises:

a first central planar portion;

a second central planar portion; and a frontal planar portion that is orthogonal to the second central planar portion, wherein the frontal planar portion is adapted to contact a support base when displaying the item.

7. The rack of claim 1, further comprising:

the first member including a first front edge;

the second member including a second front edge;

an opening defined between the first front edge and the second front edge, wherein the opening is in open communication with the channel, wherein the opening is adapted to allow the item to extend through the opening.

8. The rack of claim 1, wherein the second member further comprises:

a first central planar portion;

a second central planar portion terminating at a lower front edge;

an intermediate portion disposed between the first central planar portion and the second planar portion.

9. The rack of claim 1, further comprising:

the second member disposed below the first member, wherein the second member includes an upper planar portion, a first central planar portion, a second central planar portion, an intermediate portion between the first central planar portion and the second central planar portion, and a frontal planar portion.

10. The rack of claim 9, further comprising:

a third bend between the intermediate portion and the second central planar portion.

11. The rack of claim 9, wherein the frontal planar portion is orthogonal to the second central planar portion.

12. The rack of claim 1, further comprising:

a first extension and a second extension that extend rearward from a frontal surface of the second member at each side of the rack.

13. The rack of claim 12, wherein the second member further comprises:

an opening to the channel defined between the first extension and second extension on the second member.

* * * * *